US011629896B2

(12) United States Patent
Higashiiue et al.

(10) Patent No.: US 11,629,896 B2
(45) Date of Patent: Apr. 18, 2023

(54) HEAT EXCHANGER AND REFRIGERATION CYCLE APPARATUS

(71) Applicant: Mitsubishi Electric Corporation, Tokyo (JP)

(72) Inventors: Shinya Higashiiue, Tokyo (JP); Ryota Akaiwa, Tokyo (JP); Tsuyoshi Maeda, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 185 days.

(21) Appl. No.: 16/980,465

(22) PCT Filed: May 1, 2018

(86) PCT No.: PCT/JP2018/017427
§ 371 (c)(1),
(2) Date: Sep. 14, 2020

(87) PCT Pub. No.: WO2019/211893
PCT Pub. Date: Nov. 7, 2019

(65) Prior Publication Data

US 2021/0018233 A1 Jan. 21, 2021

(51) Int. Cl.
*F25B 39/02* (2006.01)
*F28D 1/04* (2006.01)
(Continued)

(52) U.S. Cl.
CPC ..... *F25B 39/02* (2013.01); *F28D 1/05383* (2013.01); *F28F 1/32* (2013.01); *F25B 2339/02* (2013.01)

(58) Field of Classification Search
CPC ..... F28D 1/05383; F28D 1/05366; F28D 1/05391; F28D 1/0426; F28F 9/026;
(Continued)

(56) References Cited

U.S. PATENT DOCUMENTS 5,979,547 A * 11/1999 Shinmura ..... F28F 9/027 165/174
6,302,197 B1 * 10/2001 Hornby ..... F28F 1/02 165/173
(Continued)

FOREIGN PATENT DOCUMENTS

EP 3136039 A1 3/2017
JP H07-091873 A 4/1995
(Continued)

OTHER PUBLICATIONS

International Search Report of the International Searching Authority dated Jul. 10, 2018 for the corresponding International application No. PCT/JP2018/017427 (and English translation).
(Continued)

*Primary Examiner* — Frantz F Jules
*Assistant Examiner* — Jason N Thompson
(74) *Attorney, Agent, or Firm* — Posz Law Group, PLC

(57) ABSTRACT

A heat exchanger includes: a plurality of flat tubes arranged in a height direction of the heat exchanger; a connection portion in which a plurality of connection spaces are provided as spaces with which ends of the plurality of flat tubes are connected; and a refrigerant distributor connected to each of the plurality of connection spaces. The flat tubes each have a first side end portion located on a windward side, a second side end portion located on a leeward side, and a plurality of refrigerant passages arranged between the first and second side end portions. Each flat tube is inclined such that in the height direction, the position of the first side end portion is lower than the position of the second side end portion. The connection spaces are spaced from each other in the height direction, and a lower side of each of the connection spaces has a first region located on the windward side and a second region located on the leeward side, and is
(Continued)

inclined such that in the height direction, the position of the first region is lower than a position of the second region.

3 Claims, 4 Drawing Sheets

(51) Int. Cl.
*F28D 1/053* (2006.01)
*F28F 9/02* (2006.01)
*F28F 1/32* (2006.01)

(58) Field of Classification Search
CPC ..... F28F 9/0278; F28F 9/027; F25B 39/028; F25B 2339/02; F25B 2313/0292; F25B 2600/2511; F25B 5/04; F25B 6/04
See application file for complete search history.

(56) References Cited

U.S. PATENT DOCUMENTS

2006/0048928 A1* 3/2006 Maezawa ..... F28F 9/0275 165/173
2011/0120177 A1* 5/2011 Kirkwood ..... F28F 1/325 165/173
2013/0175013 A1* 7/2013 Yoshioka ..... B23K 1/0012 165/165
2015/0211802 A1* 7/2015 Yokozeki ..... F28F 1/325 165/104.14
2016/0178292 A1* 6/2016 Matsui ..... F25B 39/022 165/104.21
2016/0195335 A1* 7/2016 Nishiyama ..... F28D 1/05366 165/174
2019/0033018 A1* 1/2019 Higashiiue ..... F28F 9/22

FOREIGN PATENT DOCUMENTS

JP H10-170182 A 6/1998
JP 2004-069228 A 3/2004
JP 2015-055413 A 3/2015
JP 2016-125748 A 7/2016
WO 2015/162678 A1 10/2015

OTHER PUBLICATIONS

Office Action dated Jul. 5, 2021, issued in corresponding CN Patent Application No. 201880091794.3 (and English Machine Translation).
Office Action dated May 25, 2021 issued in corresponding JP patent application No. 2020-516986 (and English translation).
Extended European Search Report dated Feb. 26, 2021, issued in corresponding European Patent Application No. 18917178.8.

* cited by examiner

HEAT EXCHANGER AND REFRIGERATION CYCLE APPARATUS

CROSS REFERENCE TO RELATED APPLICATION

This application is a U.S. national stage application of PCT/JP2018/017427 filed on May 1, 2018, the contents of which are incorporated herein by reference.

TECHNICAL FIELD

The present disclosure relates to a heat exchanger including a plurality of flat tubes and a refrigeration cycle apparatus.

BACKGROUND ART

Patent Literature 1 describes a heat exchanger including a windward heat exchanger unit, a leeward heat exchanger unit, and a connection unit that is provided adjacent to an end portion of the windward heat exchanger unit and an end portion of the leeward heat exchanger unit. The connection unit includes N communication passages that cause end portions of N flat tubes of the windward heat exchanger unit to communicate with end portions of respective N flat tubes of the leeward heat exchanger unit. It is therefore possible to easily uniformize the mass flow rate of refrigerant that flows in each of the flat tubes.

CITATION LIST

Patent Literature

Patent Literature 1: Japanese Unexamined Patent Application Publication No. 2015-55413

SUMMARY OF INVENTION

Technical Problem

Flat tubes each have a plurality of fluid passages arranged in the width direction of each flat tube. In the heat exchanger of Patent Literature 1, the mass flow rate of the refrigerant that flows in each of the flat tubes is uniformized, and the mass flow rate of the refrigerant that flows in each of the plurality of fluid passages in each flat tube is thus also uniformized. However, even if the mass flow rate of the refrigerant that flows in each of the plurality of fluid passages in each flat tube is uniformized, a heat exchanger performance, that is, the performance of the heat exchanger, cannot necessarily be improved.

The present disclosure is applied to solve the above problem, and relates to a heat exchanger and a refrigeration cycle apparatus that are capable of improving the heat exchanger performance.

Solution to Problem

A heat exchanger according to an embodiment of the present disclosure includes: a plurality of flat tubes extending in a horizontal direction and arranged in a height direction of the heat exchanger, the plurality of flat tubes being provided to allow refrigerant to flow therethrough; a connection portion in which a plurality of connection spaces are provided as spaces with which ends of the plurality of flat tubes are connected; and a refrigerant distributor connected to each of the plurality of connection spaces. Each of the plurality of flat tubes has a first side end portion located on a windward side, a second side end portion located on a leeward side, and a plurality of refrigerant passages arranged between the first side end portion and the second side end portion, and is inclined such that in the height direction, a position of the first side end portion is lower than a position of the second side end portion. The plurality of connection spaces are spaced from each other in the height direction. A lower side of each of the plurality of connection spaces has a first region located on the windward side and a second region located on the leeward side, and is inclined such that in the height direction, a position of the first region is lower than a position of the second region.

A refrigeration cycle apparatus according to another embodiment of the present disclosure includes the heat exchanger according to the above embodiment of present disclosure.

Advantageous Effects of Invention

According to the embodiments of the present disclosure, in the case where the refrigerant that has been distributed to the connection spaces by the refrigerant distributor is made to flow into the plurality of refrigerant passages of each of the flat tubes, the refrigerant can be made to flow into the plurality of refrigerant passages such that the closer the refrigerant passage to the first side end portion, the higher the ratio of liquid to gas in the refrigerant that flows into refrigerant passage. Thus, refrigerant having a high ratio of liquid to gas can be made to flow through refrigerant passages close to the first side end portion that have a high heat transfer coefficient between refrigerant and air, and it is therefore possible to promote evaporation of liquid refrigerant. Therefore, the heat exchanger performance of the heat exchanger can be improved.

DESCRIPTION OF EMBODIMENTS

Embodiment 1

Figure 1:
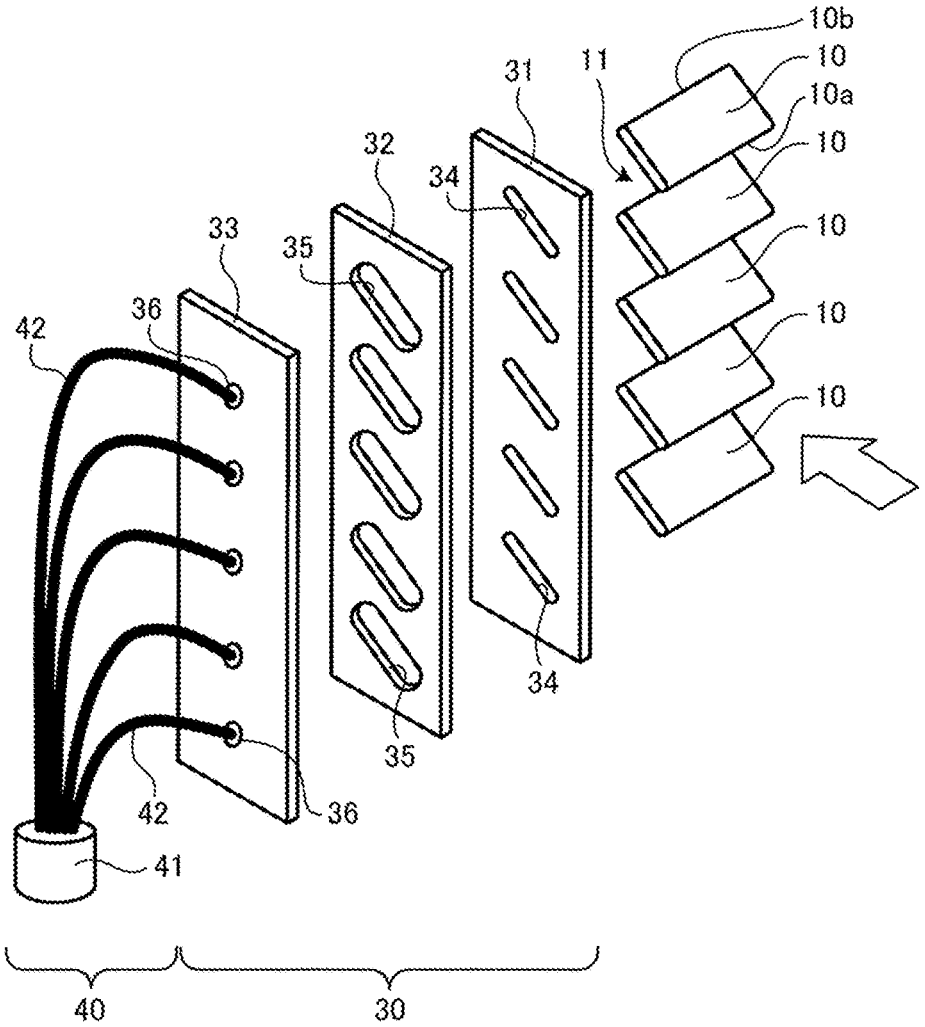
FIG. 1 is an exploded perspective view of a configuration of a heat exchanger according to Embodiment 1 of the present disclosure.

A heat exchanger according to Embodiment 1 of the present disclosure will be described. FIG. 1 is an exploded perspective view of a configuration of the heat exchanger according to Embodiment 1. The heat exchanger according to Embodiment 1 is an air heat exchanger that causes heat exchange to be performed between air and refrigerant, and operates at least as an evaporator of a refrigeration cycle apparatus. In FIG. 1, the flow direction of air is indicated by an outlined arrow. As illustrated in FIG. 1, the heat exchanger includes a plurality of flat tubes 10 that allow refrigerant to flow therethrough, a connection portion 30 connected to an end of each of the plurality of flat tubes 10 that is located on one end side of each flat tube 10 in an extending direction thereof, and a refrigerant distributor 40 that distributes refrigerant that has flowed into the refrigerant distributor 40 from the outside thereof to the plurality of flat tubes 10 via the connection portion 30. The plurality of flat tubes 10 extend in a horizontal direction. The plurality of flat tubes 10 are arranged in a height direction of the heat exchanger, i.e., a direction along the height of the heat exchanger. Between any adjacent two of the plurality of flat tubes 10, a space 11 is provided to serve as an air flow passage. Alternatively, between any two adjacent flat tubes 10, a heat transfer fin may be provided. To the other end of each of the plurality of flat tubes 10 in the extending direction thereof, a header collecting pipe not illustrated is connected. When the heat exchanger operates as an evaporator of the refrigeration cycle apparatus, refrigerant flows from the above one end of each of the flat tubes 10 toward the other end thereof. When the heat exchanger operates as a condenser of the refrigeration cycle apparatus, refrigerant flows from the other end of each flat tube 10 toward the one end thereof.

Figure 2:
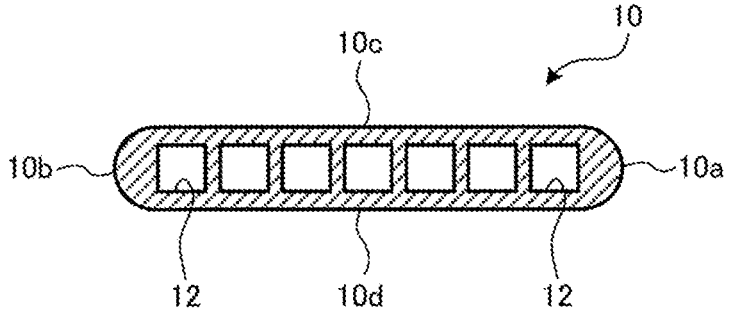
FIG. 2 is a sectional view of a configuration of each of flat tubes 10 of the heat exchanger according to Embodiment 1 of the present disclosure.

FIG. 2 is a sectional view of a configuration of each of the flat tubes 10 of the heat exchanger according to Embodiment 1. FIG. 2 illustrates a section perpendicular to the extending direction of the flat tube 10. As illustrated in FIG. 2, the flat tube 10 has a sectional shape that is elongated in one direction, such as an elliptical shape. The flat tube 10 has a first side end portion 10*a*, a second side end portion 10*b*, and a pair of flat surfaces 10*c* and 10*d*. In the section as illustrated in FIG. 2, the first side end portion 10*a* is continuous with the flat surface 10*c* and the flat surface 10*d* on one end side of the flat surface 10*c* and one end side of the flat surface 10*d*. Similarly, the second side end portion 10*b* is continuous with the flat surface 10*c* and the flat surface 10*d* on the other end side of the flat surface 10*c* and the other end side of the flat surface 10*d*. The first side end portion 10*a* is a side end portion that is located on a windward side in the flow of air that passes through the heat exchanger, that is, on a front edge side. The second side end portion 10*b* is a side end portion that is located on a leeward side in the flow of air that passes through the heat exchanger, that is, a back edge side. Hereinafter, a direction perpendicular to the extending direction of the flat tube 10 and parallel to the flat surfaces 10*c* and 10*d* (lateral direction in FIG. 2) will sometimes be referred to as a major axis direction of the flat tube 10.

The flat tube 10 has a plurality of refrigerant passages 12 provided between the first side end portion 10*a* and the second side end portion 10*b* and arranged in the major axis direction. Each of the plurality of refrigerant passages 12 extends parallel to the extending direction of the flat tube 10.

Referring back to FIG. 1, each of the plurality of flat tubes 10 is inclined relative to a horizontal plane such that in the height direction of the heat exchanger, the position of the first side end portion 10*a* located on the windward side is lower than the position of the second side end portion 10*b* located on the leeward side.

Figure 3:
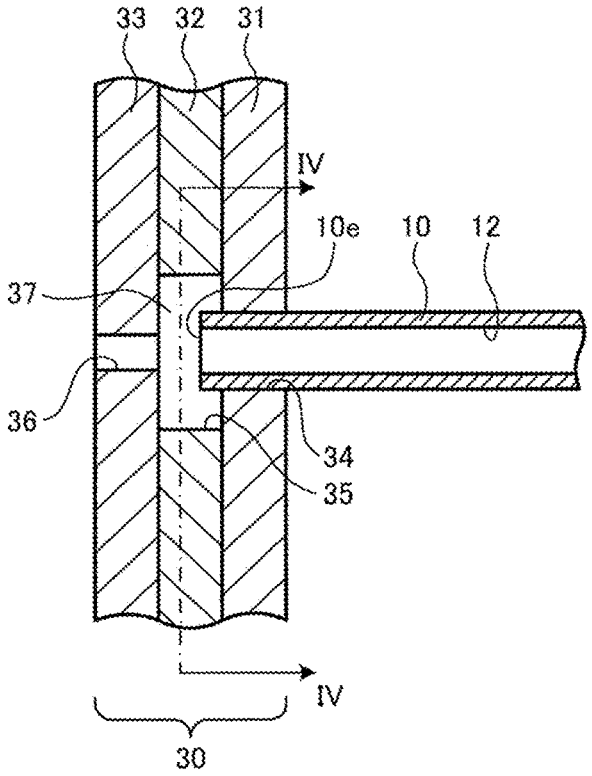
FIG. 3 is a sectional view of a structure in which the flat tube 10 and a connection portion 30 of the heat exchanger according to Embodiment 1 of the present disclosure are connected to each other.

FIG. 3 is a sectional view of a structure in which the flat tube 10 and the connection portion 30 in the heat exchanger according to Embodiment 1 are connected to each other. FIG. 3 illustrates a section parallel to the extending direction of the flat tube 10 and perpendicular to the major axis direction of the flat tube 10. As illustrated in FIGS. 1 and 3, the connection portion 30 has a configuration in which a first plate-shaped member 31, a second plate-shaped member 32, and a third plate-shaped member 33 that all extend in a direction perpendicular to the extending direction of the flat tube 10, are stacked. Each of the first plate-shaped member 31, the second plate-shaped member 32, and the third plate-shaped member 33 has a rectangular flat-plate shape that is elongated in the height direction.

The first plate-shaped member 31 has a plurality of first through holes 34 in each of which one end of an associated one of the flat tubes 10 is fitted and fixed. The plurality of first through holes 34 are arranged in the height direction. Each of the plurality of first through holes 34 has an elongated shape as well as the outer peripheral shape of the flat tube 10, and is inclined in a direction in which the flat tube 10 is inclined. An opening edge of each first through hole 34 is joined to an entire outer peripheral surface of an associated one of the flat tubes 10 by brazing or other methods.

The second plate-shaped member 32 has a plurality of second through holes 35. The plurality of second through holes 35 are arranged in the height direction and spaced from each other in the height direction. Each of the plurality of second through holes 35 has a flattened shape as well as the outer peripheral shape of the flat tube 10. The opening area of the second through hole 35 is larger than or equal to the opening area of the first through hole 34. As viewed in a direction parallel to the extending direction of the flat tube 10, an opening edge of the second through hole 35 is located outward of the outer peripheral surface of the flat tube 10. The second through hole 35 has a connection space 37 inside of the second through hole 35. One end of the flat tube 10 passes through the first through hole 34 and reaches the second through hole 35. Thus, a tip portion 10*e* at the end of the flat tube 10 is located in the connection space 37. That is, the end of the flat tube 10 is connected directly with the connection space 37. The connection space 37 communicates with the plurality of refrigerant passages 12 of the flat tube 10 connected with the connection space 37.

The third plate-shaped member 33 has a plurality of third through holes 36 that communicate the respective connection spaces 37. The plurality of third through holes 36 are arranged in the height direction. Each of the third through hole 36 has, for example, a circular shape. The opening area of the third through hole 36 is smaller than the opening area of the second through hole 35.

The refrigerant distributor 40 includes a flow divider 41 that divides refrigerant and a plurality of capillary tubes 42 that connects the flow divider 41 with the plurality of connection spaces 37. Regarding Embodiment 1, although the refrigerant distributor 40 having a distributor system is illustrated as an example, the type of the refrigerant distributor 40 is not limited to the above type. The refrigerant distributor 40 may be a stacked type refrigerant distributor in which a plurality of plate-shaped members are stacked and may be a header type refrigerant distributor including a header tank. In addition, the refrigerant distributor 40 and the connection portion 30 may be formed as a single body.

Figure 4:
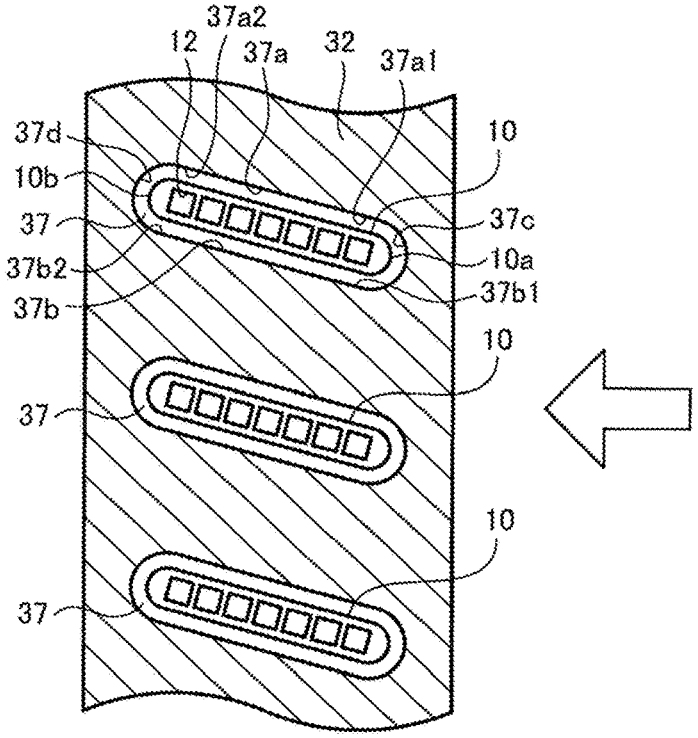
FIG. 4 is a sectional view taken along line IV-IV of FIG. 3.

FIG. 4 is a sectional view taken along line IV-IV in FIG. 3. In FIG. 4, the height direction is a vertical direction. In FIG. 4, the flow direction of air is indicated by an outlined arrow. As illustrated in FIG. 4, the plurality of connection spaces 37 are provided in the respective flat tubes 10. The plurality of connection spaces 37 are spaced from each other at least in the height direction. As viewed in a direction parallel to the extending direction of each flat tube 10, each of the connection spaces 37 has an elongated shape such as an elliptical shape. Each connection space 37 is defined by an upper side 37*a*, a lower side 37*b*, a first side 37*c*, and a second side 37*d*; and the upper side 37*a* and the lower side 37*b* have a planar shape and the first side 37*c* and the second side 37*d* have an arc shape. The upper side 37*a*, the lower side 37*b*, the first side 37*c*, and the second side 37*d* correspond to the opening edge of the second through hole 35. The first side 37*c* is located on the windward side of the connection space 37 and faces the first side end portion 10*a* of the flat tube 10. The second side 37*d* is located on the leeward side of the connection space 37 and faces the second side end portion 10*b* of the flat tube 10. The connection space 37 is inclined such that in the height direction, the position of the first side 37*c* is lower than the position of the second side 37*d*. Thus, the lower side 37*b* of the connection space 37 is inclined in the direction in which the flat tube 10 is inclined. The lower side 37*b* has a first region 37*b*1 located on the windward side and a second region 37*b*2 located leeward of the first region 37*b*1. In the height direction, the position of the first region 37*b*1 is lower than the position of the second region 37*b*2. That is, the lower side 37*b* is inclined such that the windward side of the lower side 37*b* is located lower than the leeward side thereof in the direction of gravity. Although in the configuration as illustrated in FIG. 4, the inclination angle of the lower side 37*b* is the same as the inclination angle of the flat tube 10, it is not indispensable that the inclination angle of the lower side 37*b* is the same as the inclination angle of the flat tube 10. Similarly, the upper side 37*a* of the connection space 37 is inclined in the direction in which the flat tube 10 is inclined. The upper side 37*a* has a third region 37*a*1 located on the windward side and a fourth region 37*a*2 located leeward of the third region 37*a*1. In the height direction, the position of the third region 37*a*1 is lower than the position of the fourth region 37*a*2. That is, the upper side 37*a* is inclined such that the windward side of the upper side 37*a* is lower than the leeward side thereof in the direction of gravity. Although in the configuration as illustrated in FIG. 4, the inclination angle of the upper side 37*a* is the same as the inclination angle of the flat tube 10, it is not indispensable that the inclination angle of the upper side 37*a* is the same as the inclination angle of the flat tube 10.

Figure 5:
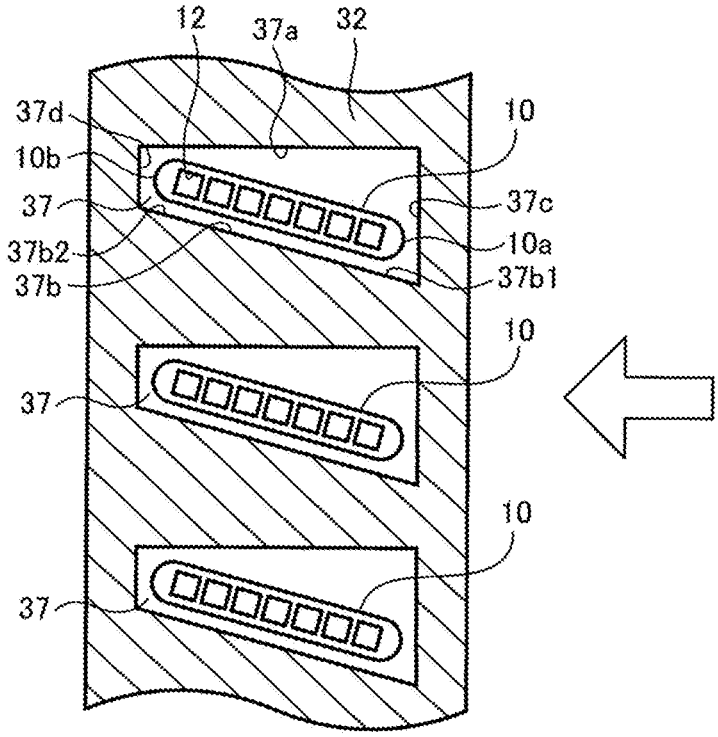
FIG. 5 is a sectional view of a modification of the configuration of the heat exchanger according to Embodiment 1 of the present disclosure.

In addition, although in the configuration illustrated in FIG. 4, the upper side 37*a*, the first side 37*c*, and the second side 37*d* are formed along the shape of the flat tube 10, it is not necessarily indispensable that the upper side 37*a*, the first side 37*c*, and the second side 37*d* are formed along the shape of the flat tube 10. FIG. 5 is a sectional view of a modification of the configuration of the heat exchanger according to Embodiment 1. FIG. 5 illustrates a section of a portion corresponding to the portion illustrated in FIG. 4. As illustrated in FIG. 5, the upper side 37*a* of the connection space 37 is formed to extend in the horizontal direction, not along the shape of the flat tube 10. The first side 37*c* and the second side 37*d* of the connection space 37 are formed to extend in the height direction, not along the shape of the flat tube 10. The lower side 37*b* is inclined such that in the height direction, the position of the first region 37*b*1 is lower than the position of the second region 37*b*2, as in the configuration as illustrated in FIG. 4.

An operation of the heat exchanger according to Embodiment 1 will be described. When the heat exchanger operates as an evaporator of the refrigeration cycle apparatus, two-phase gas-liquid refrigerant flows into the refrigerant distributor 40 from the outside. The two-phase gas-liquid refrigerant that has flowed into the refrigerant distributor 40 is equally distributed to the plurality of capillary tubes 42 by the flow divider 41. The two-phase gas-liquid refrigerant distributed to each of the capillary tubes 42 is supplied from each capillary tube 42 to an associated one of the plurality of connection spaces 37.

Figure 6:
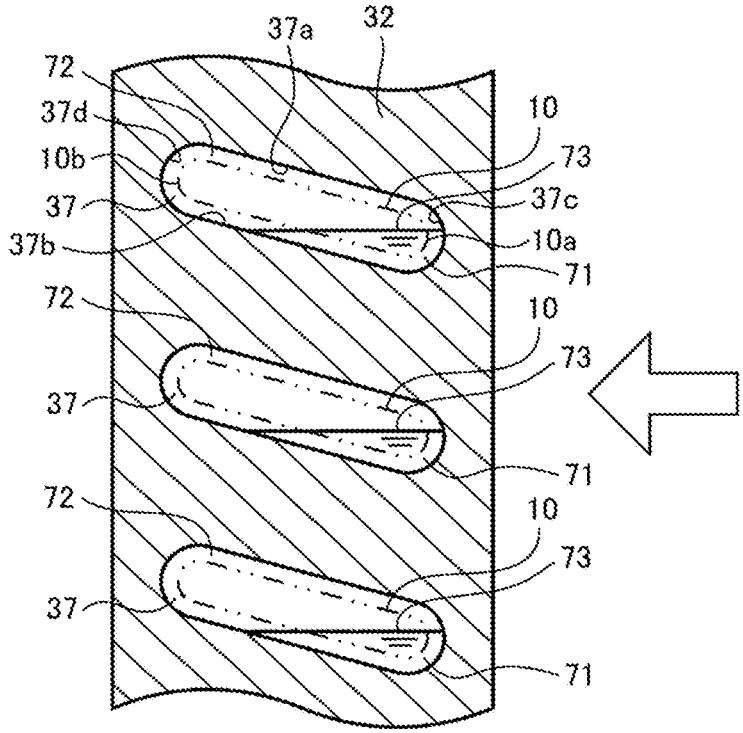
FIG. 6 illustrates states of connection spaces 37 in the case where the heat exchanger according to Embodiment 1 of the present disclosure operates as an evaporator.

FIG. 6 illustrates states of the connection spaces 37 in the case where the heat exchanger according to Embodiment 1 operates as an evaporator. FIG. 6 illustrates the same section as FIG. 4. As illustrated in FIG. 6, of two-phase gas-liquid refrigerant that has flowed into each of the connection spaces 37, liquid refrigerant 71 having a high density moves to a lower region of the connection space 37. Of the two-phase gas-liquid refrigerant, gas refrigerant 72 having a low density moves to an upper region of the connection space 37. Because of inclination of the lower side 37*b*, the liquid refrigerant 71 collects near the first side 37*c* of the connection space 37 and the gas refrigerant 72 collects near the second side 37*d* of the connection space 37. A liquid surface 73 that is an interface between the liquid refrigerant 71 and the gas refrigerant 72 is inclined relative to a direction in which the plurality of refrigerant passages 12 are arranged, that is, relative to the major axis direction of the flat tube 10. Thus, into the refrigerant passages 12, respective refrigerant having different gas-liquid ratios flow from the connection space 37. In this case, the closer the refrigerant passage 12 to the first side end portion 10*a*, the higher the ratio of liquid to gas in the refrigerant that flow into the refrigerant passage 12. Single-phase liquid refrigerant or two-phase gas-liquid refrigerant having the highest ratio of liquid to gas flows into one of the refrigerant passages 12 that is the closest to the first side end portion 10*a*. In contrast, the closer the refrigerant passage 12 to the second side end portion 10*b*, the higher the ratio of gas to liquid in refrigerant that flows into the refrigerant passage 12.

The refrigerant that has flowed into the plurality of refrigerant passages 12 of the flat tube 10 flows in the extending direction of the flat tube 10. The refrigerant that flows through the plurality of refrigerant passages 12 exchanges heat with air to evaporate and thus change into gas refrigerant, and the gas refrigerant then flows into the header collecting pipe provided on the other end side of the flat tube 10.

It should be noted that in the first side end portion 10*a* of the flat tube 10 that is located on the windward side and corresponds to a front edge of the flat tube 10, the heat transfer coefficient between refrigerant and air is highest in the flat tube 10. Thus, by causing refrigerant having a high ratio of liquid to gas to flow through refrigerant passages 12 close to the first side end portion 10*a*, evaporation of liquid refrigerant can be promoted. Therefore, according to Embodiment 1, it is possible to improve the heat exchanger performance of the heat exchanger. Because of improvement of the heat exchanger performance, a refrigeration cycle circuit can be efficiently operated, thereby improving the energy efficiency of the refrigeration cycle apparatus to achieve energy saving.

In the case where a flat tube is used as a heat transfer tube in a heat exchanger, the pressure loss of refrigerant is large, as compared with the case where a circular pipe is used as the heat transfer tube. Thus, the number of paths of the heat exchanger needs to be increased. Therefore, in general, a heat exchanger employing a flat tube is provided with a refrigerant distributor having multiple branches. As the number of branches of the refrigerant distributor is increased, the number of connection spaces is also increased, and the total volume of connection spaces in the heat exchanger is thus increased. Consequently, since the amount of refrigerant that remains in the connection spaces is increased, the amount of refrigerant in the refrigeration cycle apparatus may be increased. In contrast, in Embodiment 1, both the upper side 37*a* and the lower side 37*b* of connection space 37 are inclined in the direction in which the flat tube 10 are inclined. Thus, it is possible to provide both the upper side 37*a* and the lower side 37*b* along the outer peripheral surface of the flat tube 10 and to reduce the volume of the connection space 37. Accordingly, it is possible to reduce an increase in the total volume of all the connection spaces 37 in the heat exchanger. Therefore, according to Embodiment 1, it is also possible to reduce the amount of refrigerant in the refrigeration cycle apparatus.

When the heat exchanger of Embodiment 1 operates as an evaporator of the refrigeration cycle apparatus, the temperature of the refrigerant that flows in each flat tube 10 is lower than the temperature of air. When the surface temperature of the flat tube 10 or a heat transfer fin becomes lower than or equal to the dew-point temperature of air, condensation occurs on the surface of the flat tube 10 or the heat transfer fin. In Embodiment 1, because the flat tube 10 is inclined, condensation water on the surface of the flat tube 10 or the heat transfer fin smoothly flows downwards without remaining on an upper surface of the flat tube 10. Therefore, according to Embodiment 1, it is possible to cause condensation water to easily flow out of the heat exchanger.

Furthermore, the heat exchanger of Embodiment 1 can be used as an outdoor heat exchanger of the refrigeration cycle apparatus. In this case, in the case where the heat exchanger operates as an evaporator when the temperature of outside air is low, condensation water changes into frost and adheres to the heat exchanger. Thus, the refrigeration cycle apparatus periodically performs a defrosting operation to melt the frost. In Embodiment 1, since the flat tube 10 is inclined, drain water generated in the defrosting operation smoothly flows downwardly without remaining on the upper surface of the flat tube 10. Therefore, in Embodiment 1, since the drain water generated in the defrosting operation can be made to easily flow out of the heat exchanger, it is possible to reduce a defrosting time.

As described above, the heat exchanger according to Embodiment 1 includes: the plurality of flat tubes 10 that allow refrigerant to flow therethrough, and that extend in the horizontal direction and are arranged in the height direction of the heat exchanger; the connection portion 30 in which the plurality of connection spaces 37 are formed as spaces with which ends of the respective flat tubes 10 are connected; and the refrigerant distributor 40 that is connected to the plurality of connection spaces 37, and distributes refrigerant to the flat tubes 10 through the plurality of connection spaces 37. Each of the flat tubes 10 has the first side end portion 10*a* located on the windward side, the second side end portion 10*b* located on the leeward side, and the plurality of refrigerant passages 12 arranged between the first side end portion 10*a* and the second side end portion 10*b*. Each flat tube 10 is inclined such that in the height direction, the position of the first side end portion 10*a* is lower than the position of the second side end portion 10*b*. The plurality of connection spaces 37 are spaced from each other in the height direction. The lower side 37*b* of each of the plurality of connection spaces 37 has the first region 37*b*1 located on the windward side and the second region 37*b*2 located on the leeward side, and the lower side 37*b* is inclined such that in the height direction, the position of the first region 37*b*1 is lower than the position of the second region 37*b*2.

In the above configuration, the refrigerant that has been distributed to each connection space 37 by the refrigerant distributor 40 is separated into liquid refrigerant 71 that collects in a windward region in the connection space 37 and gas refrigerant 72 that collects in a leeward region in the connection space 37. Thus, when refrigerant flows from the connection space 37 into the plurality of refrigerant passages 12 of the flat tube 10, the closer the refrigerant passage 12 to the first side end portion 10*a*, the higher the ratio of liquid to gas in refrigerant that flows into the refrigerant passage 12. Thus, the refrigerant having a high ratio of liquid to gas can be made to flow through refrigerant passages 12 close to the first side end portion 10*a* that have a high heat transfer coefficient between refrigerant and air, and it is therefore possible to promote evaporation of liquid refrigerant. Therefore, the heat exchanger performance of the heat exchanger can be improved.

Furthermore, in the heat exchanger according to Embodiment 1, the upper side 37*a* of each of the plurality of connection spaces 37 may have the third region 37*a*1 located on the windward side, and the fourth region 37*a*2 located on the leeward side, and the upper side 37*a* may be inclined such that in the height direction, the position of the third region 37*a*1 is lower than the height position of the fourth region 37*a*2. In such a configuration, it is possible to reduce the volumes of the connection spaces 37, thereby reducing the amount of refrigerant in the refrigeration cycle apparatus.

Also, in the heat exchanger according to Embodiment 1, the connection portion 30 may be formed to include a plurality of plate-shaped members (for example, the first plate-shaped member 31, the second plate-shaped member 32, and the third plate-shaped member 33). In such a configuration, the connection portion 30 having the plurality of connection spaces 37 can be formed through a die-cutting process using a press machine or other machines, thereby improving the productivity of the heat exchanger.

Embodiment 2

Figure 7:
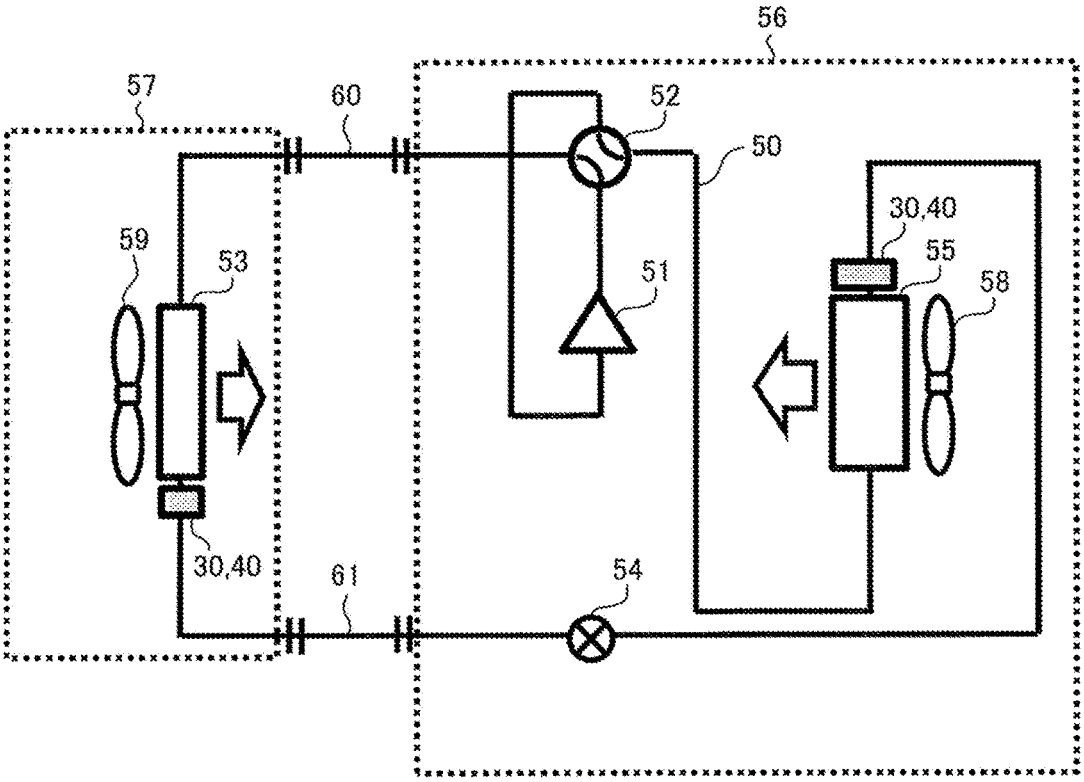
FIG. 7 is a refrigerant circuit diagram of a configuration of a refrigeration cycle apparatus according to Embodiment 2 of the present disclosure.

A refrigeration cycle apparatus according to Embodiment 2 of the present disclosure will be described. FIG. 7 is a refrigerant circuit diagram of a configuration of the refrigeration cycle apparatus according to Embodiment 2. Regarding Embodiment 2, although an air-conditioning apparatus is illustrated as an example of the refrigeration cycle apparatus, the refrigeration cycle apparatus of Embodiment 2 is also applicable as a hot water supply apparatus or other apparatuses. As illustrated in FIG. 7, the refrigeration cycle apparatus includes a refrigerant circuit 50 in which a compressor 51, a four-way valve 52, an indoor heat exchanger 53, a pressure reducing device 54, and an outdoor heat exchanger 55 are sequentially connected by refrigerant pipes. The refrigeration cycle apparatus further includes an outdoor unit 56 and an indoor unit 57. The outdoor unit 56 houses the compressor 51, the four-way valve 52, the outdoor heat exchanger 55, the pressure reducing device 54, and an outdoor fan 58 that supplies outdoor air to the outdoor heat exchanger 55. The indoor unit 57 houses the indoor heat exchanger 53 and an indoor fan 59 that supplies air to the indoor heat exchanger 53. The outdoor unit 56 and the indoor unit 57 are connected to each other by two extended pipes 60 and 61 that are each provided as part of the refrigerant pipe.

The compressor 51 is a fluid machine that compresses refrigerant sucked therein and discharges the refrigerant. The four-way valve 52 is a device that switches a flow passage for the refrigerant under control of a controller (not illustrated) between a flow passage for a cooling operation and a flow passage for a heating operation. The indoor heat exchanger 53 is a heat exchanger that transfers heat between refrigerant that flows therein and indoor air supplied by the indoor fan 59. The indoor heat exchanger 53 operates as a condenser during the heating operation and as an evaporator during the cooling operation. The pressure reducing device 54 is a device that reduces the pressure of refrigerant. As the pressure reducing device 54, it is possible to use an electronic expansion valve whose opening degree is adjusted under control of the controller. The outdoor heat exchanger 55 is a heat exchanger that transfers heat between refrigerant that flows therein and air supplied by the outdoor fan 58. The outdoor heat exchanger 55 operates as an evaporator during the heating operation and as a condenser during the cooling operation.

As at least one of the outdoor heat exchanger 55 and the indoor heat exchanger 53, the heat exchanger according to Embodiment 1 is used. Preferably, the refrigerant distributor 40 and the connection portion 30 should be provided in a region of the heat exchanger where a larger amount of liquid-phase refrigerant flows. To be more specific, preferably, the refrigerant distributor 40 and the connection portion 30 should be provided on the inlet side of the heat exchanger in the flow of refrigerant in the refrigerant circuit 50 in the case where the heat exchanger operates as an evaporator, that is, on the outlet side of the heat exchanger in the flow of refrigerant in the refrigerant circuit 50 in the case where the heat exchanger operates as a condenser.

Figure 8:
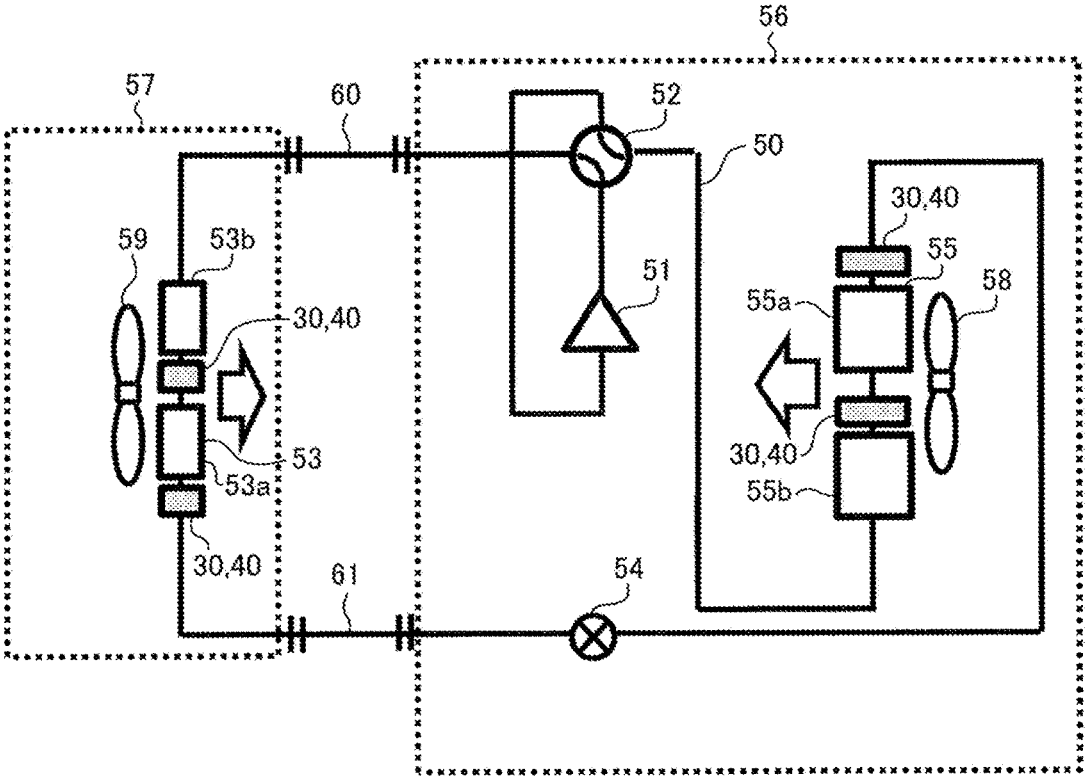
FIG. 8 is a refrigerant circuit diagram of a configuration of a refrigeration cycle apparatus according to a modification of Embodiment 2 of the present disclosure.

FIG. 8 is a refrigerant circuit diagram of a configuration of a refrigeration cycle apparatus according to a modification of Embodiment 2 of the present disclosure. As illustrated in FIG. 8, in the modification of Embodiment 2, the outdoor heat exchanger 55 is divided into a heat exchange portion 55*a* and a heat exchange portion 55*b*. The heat exchange portion 55*a* and the heat exchange portion 55*b* are connected in series in the flow of refrigerant. In addition, the indoor heat exchanger 53 is divided into a heat exchange portion 53*a* and the heat exchange portion 53*b*. The heat exchange portion 53*a* and the heat exchange portion 53*b* are connected in series in the flow of refrigerant.

Also, in the modification of Embodiment 2, preferably, the refrigerant distributor 40 and the connection portion 30 should be provided in a region of the heat exchanger where a larger amount of liquid-phase refrigerant flows. To be more specific, the refrigerant distributor 40 and the connection portion 30 should be provided on the inlet side of each of the heat exchange portions 55*a*, 55*b*, 53*a*, and 53*b* in the flow of refrigerant in the refrigerant circuit 50 in the case where the heat exchange portions 55*a*, 55*b*, 53*a*, and 53*b* operate as evaporators. In other words, preferably, the refrigerant distributor 40 and the connection portion 30 should be provided on the outlet side of each of the heat exchange portions 55*a*, 55*b*, 53*a*, and 53*b* in the flow of refrigerant in the refrigerant circuit 50 in the case where the heat exchange portions 55*a*, 55*b*, 53*a*, and 53*b* operate as condensers.

As described above, the refrigeration cycle apparatus according to Embodiment 2 includes the heat exchanger according to Embodiment 1. It is preferable that the refrigerant distributor 40 and the connection portion 30 be provided on the inlet side of the heat exchanger in the case where the heat exchanger operates as an evaporator. In the refrigeration cycle apparatus, because of provision of the above configuration, it is possible to obtain the same advantages as in Embodiment 1.

The above embodiments can be put to practical use in combination.

In the above description, "horizontal direction" means not only a perfectly horizontal direction, but a substantially horizontal direction that can be considered substantially horizontal in view of technical common knowledge.

REFERENCE SIGNS LIST

10 flat tube 10*a* first side end portion 10*b* second side end portion 10*c*, 10*d* flat surface 10*e* tip portion 11 space 12 refrigerant passage 30 connection portion 31 first plate-shaped member 32 second plate-shaped member 33 third plate-shaped member 34 first through hole 35 second through hole 36 third through hole 37 connection space 37*a* upper side 37*a*1 third region 37*a*2 fourth region 37*b* lower side 37*b*1 first region 37*b*2 second region 37*c* first side 37*d* second side 40 refrigerant distributor 41 flow divider 42 capillary tube 50 refrigerant circuit 51 compressor 52 four-way valve 53 indoor heat exchanger 53*a*, 53*b* heat exchange portion 54 pressure reducing device 55 outdoor heat exchanger 55*a*, 55*b* heat exchange portion 56 outdoor unit 57 indoor unit 58 outdoor fan 59 indoor fan 60, 61 extended pipe 71 liquid refrigerant 72 gas refrigerant 73 liquid surface

The invention claimed is:

1. A heat exchanger that operates as an evaporator of a refrigeration cycle apparatus, comprising:

a plurality of flat tubes extending in an extending direction and arranged in a height direction of the heat exchanger, the plurality of flat tubes being configured to allow refrigerant to flow therethrough;

a connection portion in which a plurality of connection spaces are provided as spaces with which ends of the plurality of flat tubes are connected; and a refrigerant distributor connected to each of the plurality of connection spaces, wherein:

each of the plurality of flat tubes has a first side end portion located on a windward side, a second side end portion located on a leeward side, and a plurality of refrigerant passages arranged between the first side end portion and the second side end portion, and each of the plurality of flat tubes is inclined such that in the height direction, a position of the first side end portion is lower than a position of the second side end portion, the plurality of connection spaces are spaced from each other in the height direction, a lower side of each of the plurality of connection spaces has a first region located on the windward side and a second region located on the leeward side, and the lower side of each of the plurality of connection spaces is inclined such that in the height direction, a position of the first region is lower than a position of the second region, an upper side of each of the plurality of connection spaces is formed to extend in a horizontal direction and is not parallel to the shape of each of the plurality of flat tubes as viewed in the extending direction, the horizontal direction is a direction orthogonal to the extending direction and the height direction, and the lower side of each of the plurality of connection spaces is parallel to the shape of each of the plurality of flat tubes as viewed in the extending direction.

2. The heat exchanger of claim 1, wherein the connection portion is formed to include a plurality of plate-shaped members.

3. A refrigeration cycle apparatus comprising the heat exchanger of claim 1.

* * * * *